US008117704B2

(12) United States Patent
Schneider et al.

(10) Patent No.: US 8,117,704 B2
(45) Date of Patent: Feb. 21, 2012

(54) SWIMMING POOL CLEANER

(75) Inventors: Helge J. Schneider, Krugersdorp (ZA); Carl Frederick Wilhelm Supra, Krugersdorp (ZA)

(73) Assignee: Integrated Pool Products (PTY) Ltd, Krugersdorp (ZA)

( * ) Notice: Subject to any disclaimer, the term of this patent is extended or adjusted under 35 U.S.C. 154(b) by 893 days.

(21) Appl. No.: 12/121,587

(22) Filed: May 15, 2008

(65) Prior Publication Data

US 2008/0307589 A1 Dec. 18, 2008

Related U.S. Application Data

(63) Continuation-in-part of application No. 12/093,934, filed as application No. PCT/IB2006/054044 on Nov. 1, 2006.

(51) Int. Cl.
*E04H 4/16* (2006.01)

(52) U.S. Cl. ..... 15/1.7; 15/387; 15/319; 180/6.66; 180/8.2

(58) Field of Classification Search ..... 15/1.7, 15/245.5, 319; 280/5.2, 5.26; 210/169
See application file for complete search history.

(56) References Cited

U.S. PATENT DOCUMENTS

| | | | | |
|---|---|---|---|---|
| 5,001,800 | A * | 3/1991 | Parenti et al. | 15/1.7 |
| 5,412,826 | A * | 5/1995 | Raubenheimer | 15/1.7 |
| 5,507,058 | A | 4/1996 | Minami et al. | |
| 5,771,987 | A * | 6/1998 | Marbach | 180/6.66 |
| 6,854,148 | B1 * | 2/2005 | Rief et al. | 15/1.7 |

FOREIGN PATENT DOCUMENTS

| | | | |
|---|---|---|---|
| EP | 0 657 603 | A1 | 6/1995 |
| IT | 0657603 | A1 * | 6/1995 |
| WO | WO03/004800 | A | 1/2003 |

OTHER PUBLICATIONS

International Search Report in corresponding PCT/IB2006/054044 issued Apr. 7, 2007.
International Preliminary Examination Report with Written Opinion in corresponding PCT/IB2006/054044 issued May 6, 2008.

* cited by examiner

*Primary Examiner* — Monica Carter
*Assistant Examiner* — Michael Jennings
(74) *Attorney, Agent, or Firm* — Marshall, Gerstein & Borun LLP

(57) ABSTRACT

The invention relates to a swimming pool cleaner with wheels driven by a turbine. The pool cleaner is intermittently turned from its path of travel along an underwater surface. A turning cam is provided inwardly of and adjacent to each of a pair of the side wheels. The cams are rotatably mounted on the turbine driven wheel axle which extends between said wheels. Each cam intermittently extends a gripping formation beyond the operatively supporting surface of the adjacent wheel. The cams will preferably comprise a disc with an integral annular internal ring gear formed. An inner gear is fixed for rotation with the axle and an outer gear is supported between the inner gear and the ring gear to rotate the cam. The inner gear is an interrupted gear member to cause intermittent stepwise rotation of the ring gear and the outer gear is a sprocket supported for unidirectional rotation. The cams and gripping formations are arranged so that, when they engage the pool surface, they impart movement to the cleaner which is in the opposite direction to the direction of travel.

13 Claims, 10 Drawing Sheets

SWIMMING POOL CLEANER

FIELD OF THE INVENTION

The invention relates to an automatic cleaner for submerged surfaces, particularly in a swimming pool.

BACKGROUND TO THE INVENTION

Automatic swimming pool cleaners of various types are widely known. One group of these has driven wheels, which carry them across submerged surfaces. They may either be suction or pressure operated.

As with all such automatic cleaners, the ongoing quest is to provide random navigation, without a repeated pattern, and to avoid the cleaner getting trapped against obstacles.

U.S. Pat. No. 6,782,578 which is limited to a pressure operated pool cleaner suggests at temporarily lifting one wheel or propping one side of the cleaner away from the pool surface to interrupt synchronous rotation of first and second wheels on the pool surface. The suggestion is anticipated by U.S. Pat. No. 5,197,158. The earlier patent discloses a random travel mechanism, located centrally between front and rear wheels and to one side of the cleaner. The mechanism periodically lifts the wheels on that side to cause a skewing of the direction of travel. These teachings with regard to such steering or interrupting mechanisms are respectively insufficient and complicated. From a commercial point of view, it is submitted that there remains room for improvement.

OBJECT OF THE INVENTION

It is an object of the present invention to provide a swimming pool cleaner of the kind referred to which at least partially satisfies the quest.

SUMMARY OF THE INVENTION

In accordance with the invention there is provided a swimming pool cleaner having wheels driven by a turbine to move the cleaner in a direction of travel along a submerged surface with a cam adjacent at least one of the wheels to intermittently extend a gripping formation beyond the operatively supporting surface of the at least one wheel and for the gripping formation to impart movement to the cleaner opposite to the direction of travel.

The invention further provides for the cam to be rotatably mounted on an axle for the at least one wheel and rotated in a direction opposite to the rotation of the at least one wheel.

Further features of the invention provide for the cam to be circular with at least one radial gripping formation; for the gripping formations to be removably securable to the cam; for the cam to be driven in a cycle retarded relative to that of the wheels; and for a turbine drive shaft to be connected through gearing to the axle for the at least one wheel, which axle is connected through gearing to a ring gear on the cam.

A further feature of the invention provides for the turbine to be in a housing with an inlet at an underside of the pool cleaner and a skirt arranged around the inlet, extending downwardly from the underside of the pool cleaner with at least part of the skirt movably suspended with a free edge of the skirt movable inwardly against a resilient bias.

Further features of the invention provide for the wheels to be adapted to receive a flotation or ballast body; and for the wheels to have tread that securably engages over hub-caps.

In accordance with another aspect of this invention there is provided a swimming pool cleaner having turbine driven wheels, with a cam adjacent at least one of the wheels to intermittently extend a gripping formation beyond the operatively supporting surface of the at least one wheel and in which the cam is rotatably mounted on an axle for the at least one wheel.

In accordance with still another aspect of this invention there is provided a swimming pool cleaner having turbine driven wheels with an annular cam adjacent at least one of the wheels mounted for rotation on a driven axle for the at least one wheel, the cam having an internal ring gear and at least one gripping formation that protrudes past the wheel periphery, an inner gear mounted on the axle for rotation with the at least one wheel and an outer gear supported between the inner gear and ring gear to rotate the cam in a direction opposite to the rotation of the wheel.

This aspect of the invention further provides for the inner gear to be an interrupted gear member to cause intermittent stepwise rotation of the ring gear; for the outer gear to be a sprocket supported for unidirectional rotation on an arm; and for the gear member to include shortened lead-in and lead-out gear teeth.

BRIEF DESCRIPTION OF THE DRAWINGS

These and other features of the invention will now be described, by way of example only, with reference to the accompanying drawings, wherein.

DETAILED DESCRIPTION OF THE INVENTION

Figure 1:
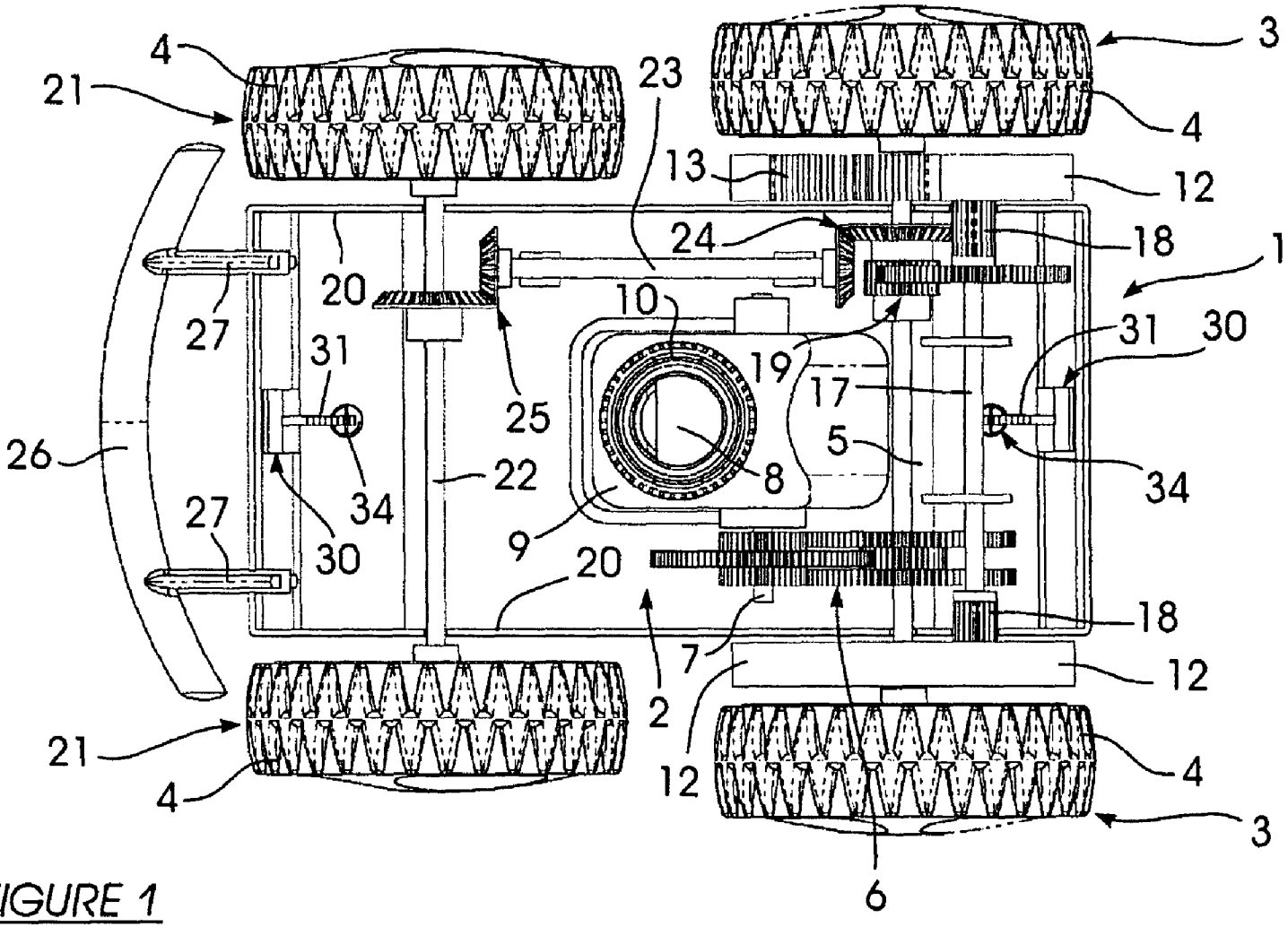
FIG. 1 shows a plan view of a swimming pool cleaner.
Figure 2:
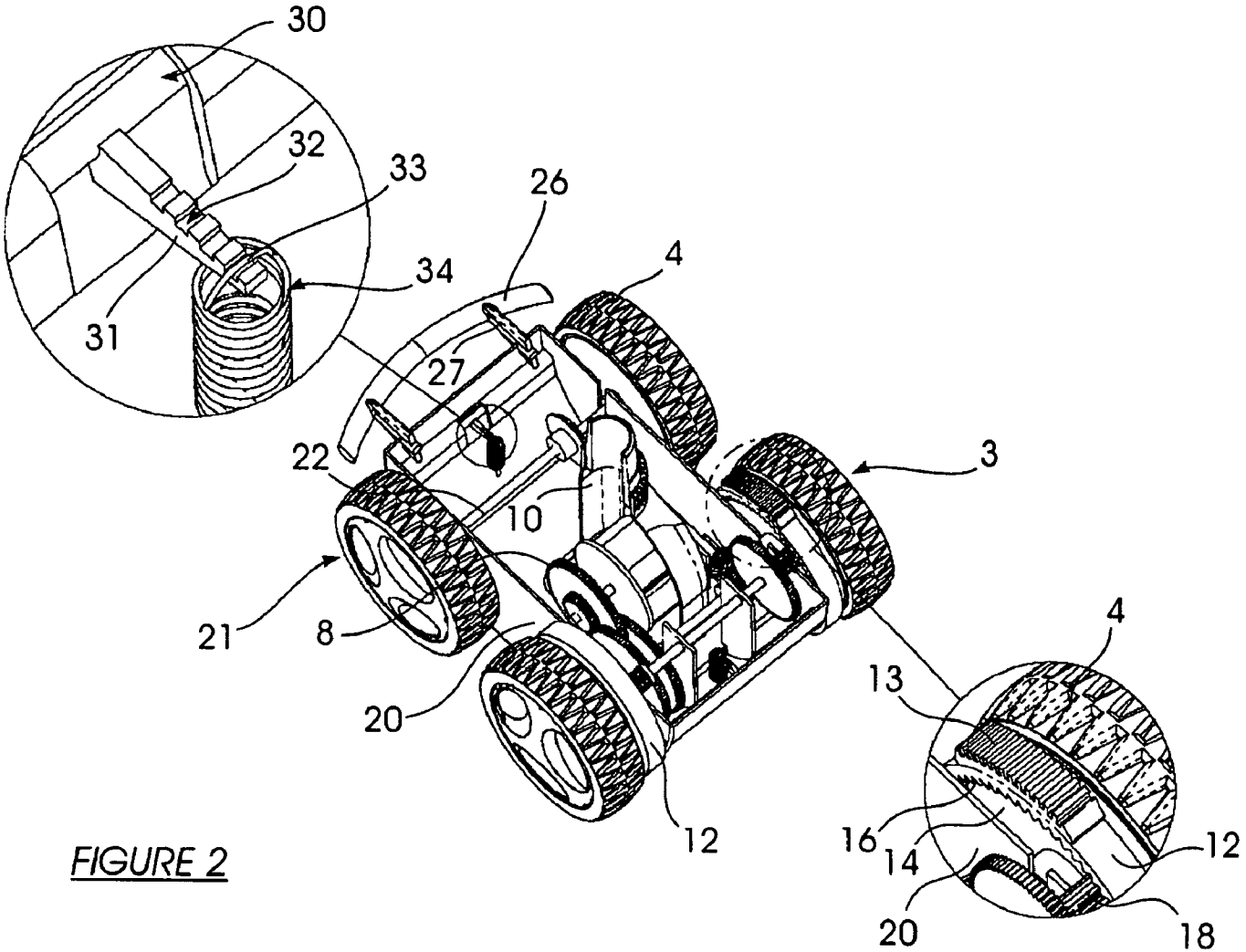
FIG. 2 shows a part cutaway perspective view of the cleaner in FIG. 1.
Figure 3:
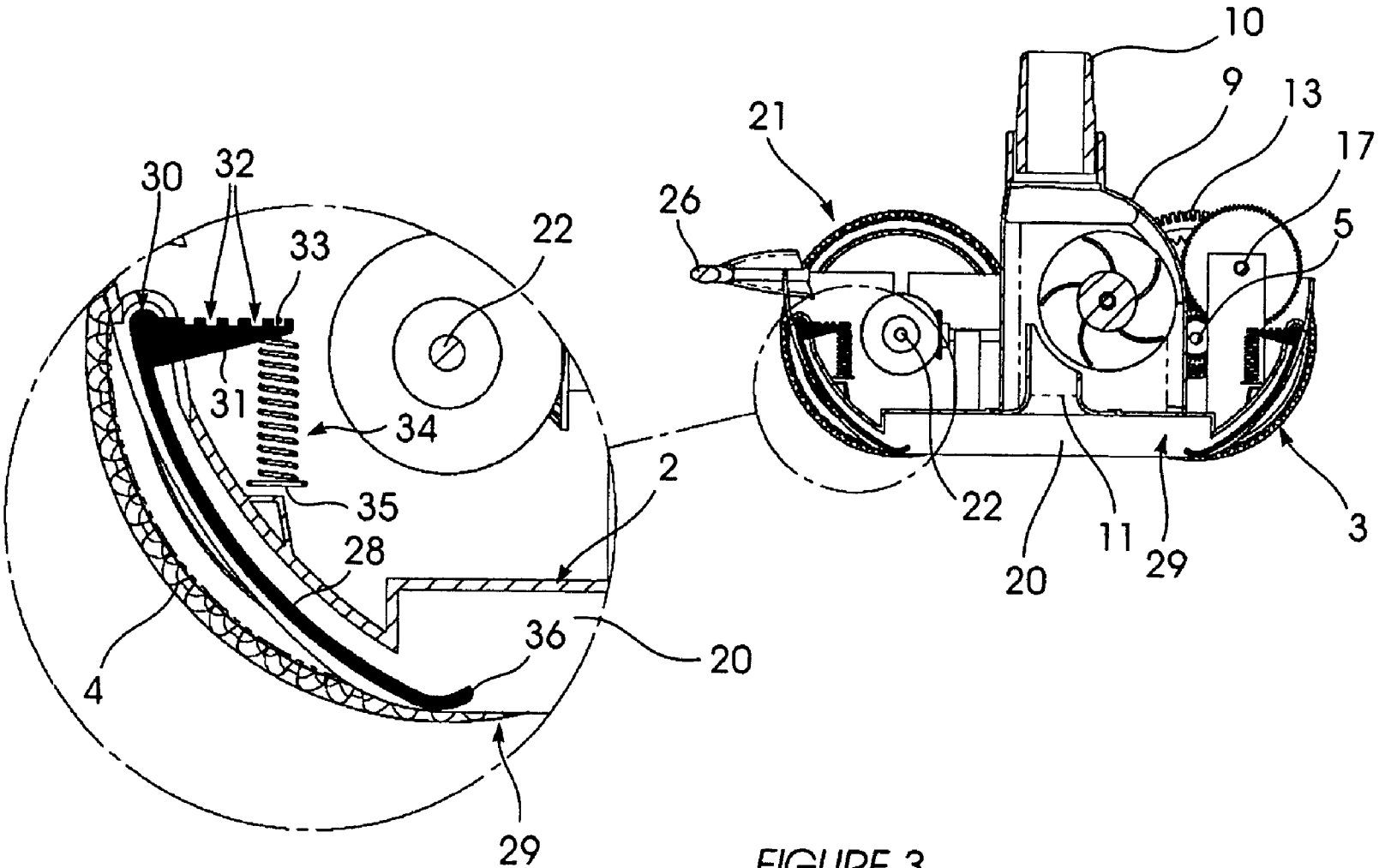
FIG. 3 shows a side cross-sectional view of the cleaner.
Figure 4:
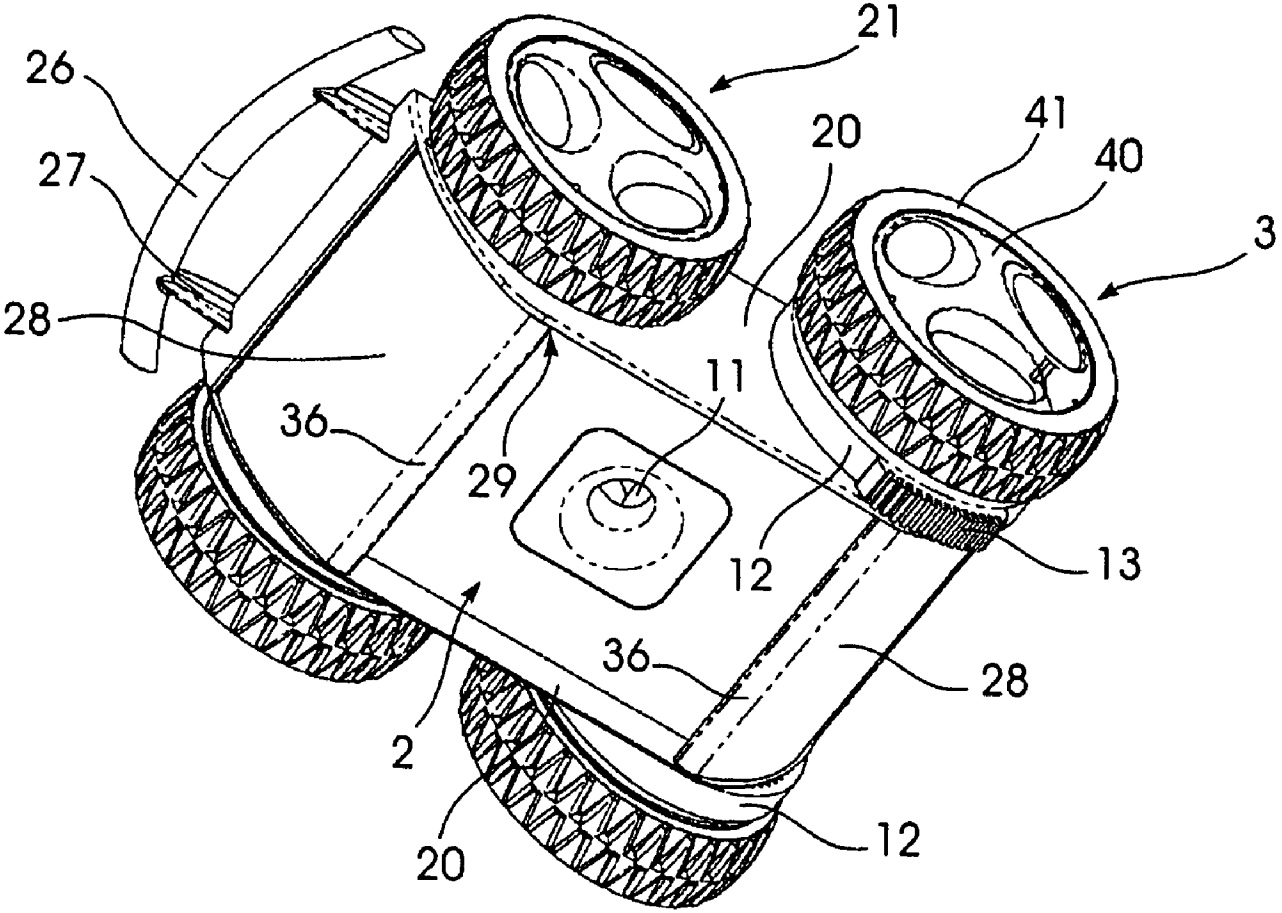
FIG. 4 shows a bottom perspective view of the cleaner.
Figure 5:
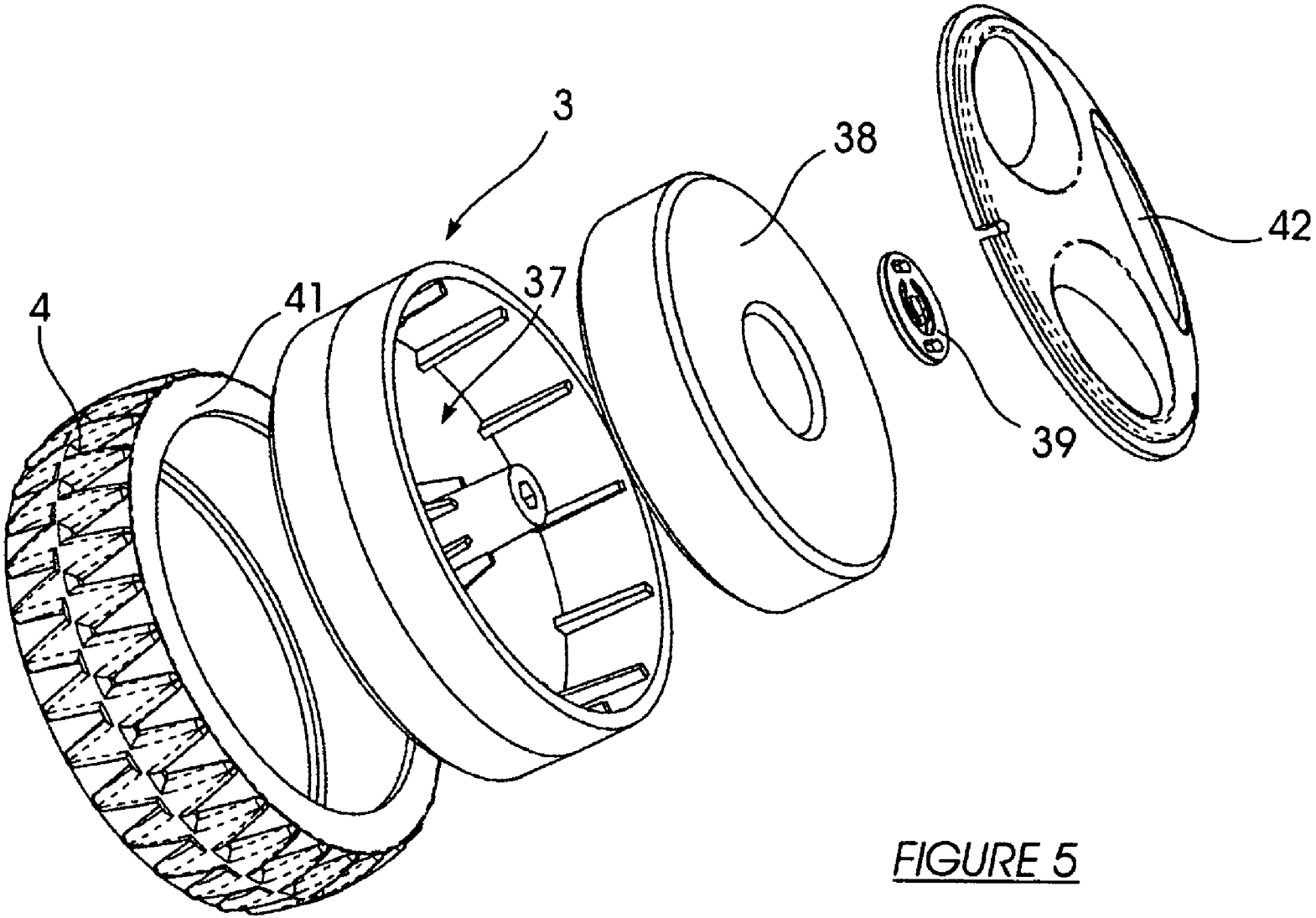
FIG. 5 shows an exploded view of a wheel for the cleaner.

Referring to FIGS. 1 to 5, a swimming pool cleaner in accordance with this invention is indicated generally by reference numeral (1). The cleaner (1) is shown without any body panels.

The cleaner (1) includes a frame (2), in the form of a pan, which has a pair of side wheels (3) adjacent its rear end. The rear wheels (3) have tread (4) of flexibly resilient material and are fixedly mounted on an axle (5). The axle (5) is connected through gears (6) to the drive shaft (7) extending from a turbine (8). The turbine (8) is mounted in a housing (9) on the frame (2).

Extending upwardly at the top of the housing (9) is an outlet (10). The outlet (10) is connectable to a swimming pool filter pump by a line of flexible hose (not shown) in the usual manner. An opening (11) in the frame (2) below the housing (9) provides an inlet.

Mounted rotatably on the wheel axle (5) is a pair of annular cams (12). Each is positioned adjacent and inwardly of a side wheel (3). The cams (12) are of a smaller diameter than the wheels (3), but carry outwardly extending radial gripping formations (13) on part of their circumference. These formations (13) extend beyond the tread (4) on the wheels (3).

Each cam (12) includes a disc (14) carrying a ring gear (16) extending laterally towards the frame (2). The outer periphery of the gear (16) is formed as a channel (not shown) which removably receives the gripping formations (13). The number, size and position of such formations (13) on the cam (12) are thus variable.

A layshaft (17) supported at the rear end of the frame (2) extends between the cams (12) and has sprockets (18) at its ends which engage the teeth of the gear (16) to provide rotation of the cams (12) in the opposite direction to that of the wheels (3). A further pair of gears (19) connects the axle (5) and layshaft (17) to transmit rotation imparted to the axle (5) from the turbine (8).

The side edges of the frame (2) are provided with walls (20) that extend along the length of the frame (2). A pair of front wheels (21) is also mounted at the sides of the cleaner (1). The wheels (21) have the same tread (4) and are connected by a front axle (22). A connecting shaft (23) extends between the rear axle (5) and front axle (22). A pair of cooperating bevel gears (24) and (25) respectively at the front and rear ends of the shaft (23) transmits rotation from the rear (5) to the front (22) axle. This arrangement drives the front wheels (21). The sidewalls (20) curve upwardly at the front and rear of the frame (2). The front and rear are shaped so as not to extend beyond the four wheels (3) and (21) to any significant degree.

At the front of the frame (2) is a bumper (26). The bumper (26) is mounted spaced apart forwardly from the cleaner (1) on a pair of supports (27). The front edge of the bumper (26) is curved, from the middle, rearwardly towards the two front wheels (21). The sidewalls (20) of the frame (2) extend downwardly to adjacent the operatively supporting surfaces at the bottom of the four wheels (3) and (21). Across the width at the front and rear of the frame (2) are downwardly extending movable flaps (28). The sidewalls (20) and flaps (28) provide a skirt (29) around the inlet (11) at the periphery of the frame (2). The flaps (28) are hinged to the frame (2) at (30). Extending from the flaps (28) adjacent the hinges (30) are levers (31). The levers (31) have spaced apart transverse grooves (32), each of which can removably receive a catch (33) at the free end of a spring (34). The other end (35) of the spring (34) is anchored to the frame (2). The tension in the spring (34) is variable by adjusting the position of the catch (33) between the grooves (32). The springs (34) resiliently bias the lower edges (36) of the flaps (28) downwardly. The flaps (28) adjacent their free, lower edges (36) are curved inwardly and upwardly. It will thus be understood that part of the skirt (29) is hingedly suspended so its free edge (36) is movable inwardly. Furthermore, the parts or flaps (28) are resiliently biased into their downwardly extending position.

The wheels (3) and (21) are provided with a cavity (37) to receive an annular body (38) therein. The body (38) will either be provided as a float or as ballast, depending on the required tuning of the cleaner (1). A circlip (39) engages on the end of the axle (5; 22) to secure the wheels (3; 21) in place. The body (38) can then be located in the cavity (37) of the wheel (3; 21) after which a hub-cap (40) is positioned against the outer edge of the wheel (3; 21). At the outer edge of the tread (4), an inwardly extending annular lip (41) is provided. The resiliently flexible lip (41) is located over the peripheral edge of the hub-cap (40) to retain it in place over the body (38).

In use, the flow of water from the inlet (11) to the outlet (10) under action of the pump rotates the turbine (8) to drive the side wheels (3) and (21), which will impart forward motion to the cleaner (1). The gearing (19) that drives the cams (12) is selected so that their cycle of rotation is slower than that of the wheels (3). The gripping formations (13) of the reverse rotation cams (12) intermittently extend beyond the bottom of their respective wheels (3). The cleaner (1) advances in a fixed direction along an operating surface until one of the gripping formations (13) comes into contact with the surface. The wheel (3) adjacent the cam (12) is then lifted off the surface. The lifting also inhibits the traction of the front wheel (21) on the same side of the cleaner (1). The gripping formation (13) on the cam (12) imparts movement to the tilted side of the cleaner (1) which is opposite to that resulting from the forwardly rotating wheels (3) and (21). The cleaner (1) thus turns under the influence of the cam (12) and the wheels (3) and (21) on the opposite side of the cleaner (1). With the other wheels (3) and (21) in contact with the pool surface, the cleaner (1) pivots under the resulting turning moment created about the cam (12).

The gripping formations (13) of the two cams (12) are located at different relative positions so that they will not engage the surface and lift both rear wheels (3) at the same time.

When the cleaner (1) engages an obstacle, the wheels (3) and (21) will spin until one of the cams (12) turns the cleaner (1) away from the obstruction. The turning is facilitated by the curved bumper (26), which assists the front end of the cleaner (1) to disengage the obstacle.

The skirt (29) contains a low pressure area below the frame (2) under the suction of water through the inlet (11) by the pump. This provides a force on the cleaner (1) to hold it against submerged surfaces and thus afford traction to the wheels (3). This also enables the cleaner (1) to climb vertical walls. The pivotable flaps (28) of the skirt (29) serve to prevent the cleaner (1) from getting stuck by creating a vacuum on, for example, a bump on the floor of a pool.

Dirt or debris in the immediate vicinity of the cleaner (1) and specifically within the area under the skirt (29) is sucked through the inlet (11), past the turbine (8) and to the filter pump.

The gripping formations (13) on the cams (12) can be adjusted as required for specific conditions, such as the size of a pool to be cleaned. It will be appreciated that by varying the size, number and position of the gripping formations (13) so too will the movement pattern of the pool cleaner (1) be varied. The gearing that drives the wheels (3; 21) and cams (12) will determine their relative speeds of rotation and this will also affect the pattern of movement.

Figure 6:
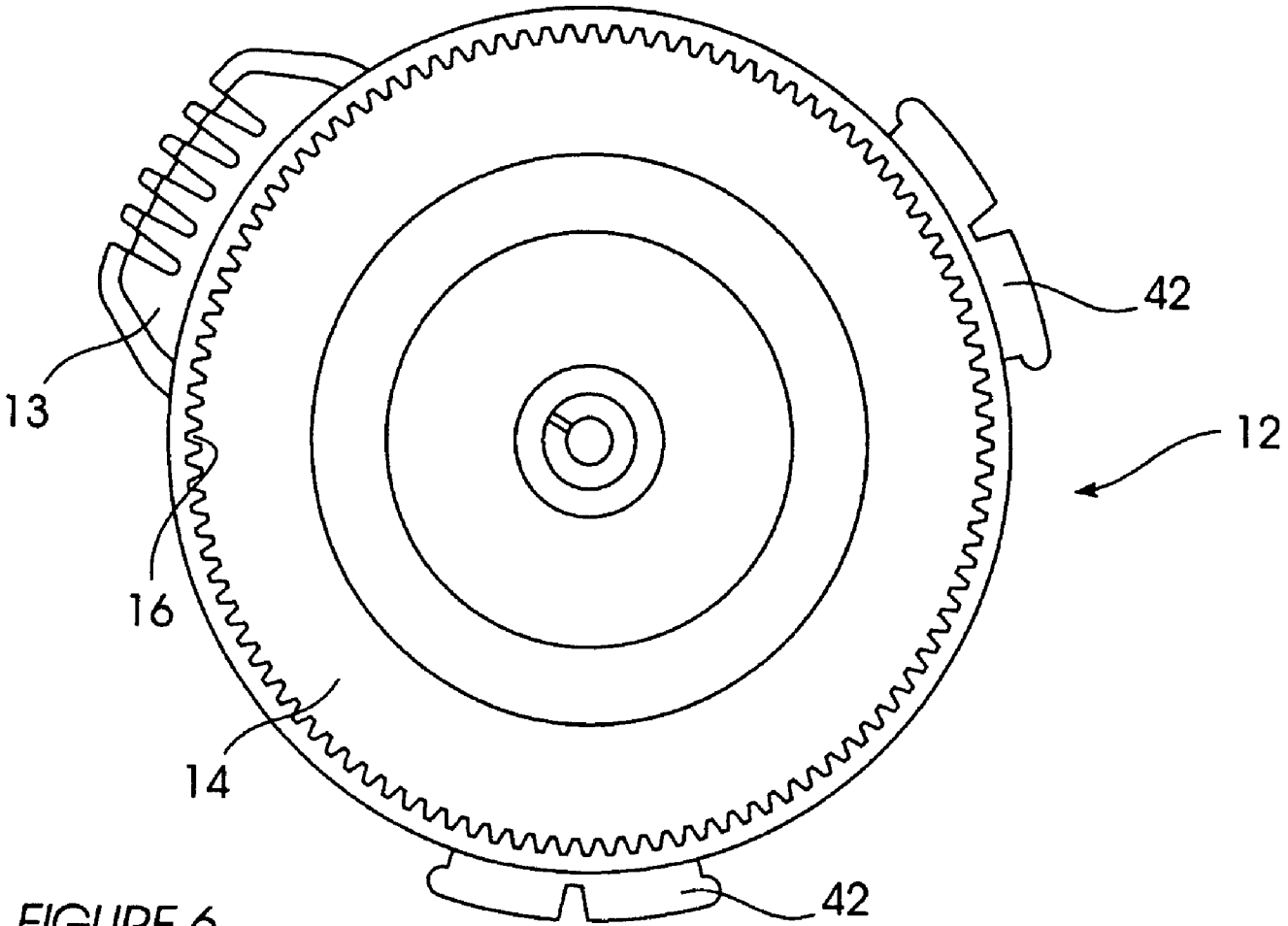
FIG. 6 shows a turning cam for a swimming pool cleaner.

FIG. 6 shows a cam (12) which has three lipped projections (42). One of these is shown fitted with an engaging formation (13). The formation (13), which is made of flexibly resilient material, has a slot (not shown) which provides an interference fit onto the projection (42). A pair on these cams (12) will be fitted to a pool cleaner (1) with the projections offset from each other to avoid simultaneous lifting of the rear wheels (3). It will be appreciated that the projections (42) themselves do not extend beyond the tread of the wheels (3) when the cam (12) is in place on the cleaner (1).

Different arrangements for securing gripping formations to the annular cams will be within the design competence of a suitably skilled person.

Figure 7:
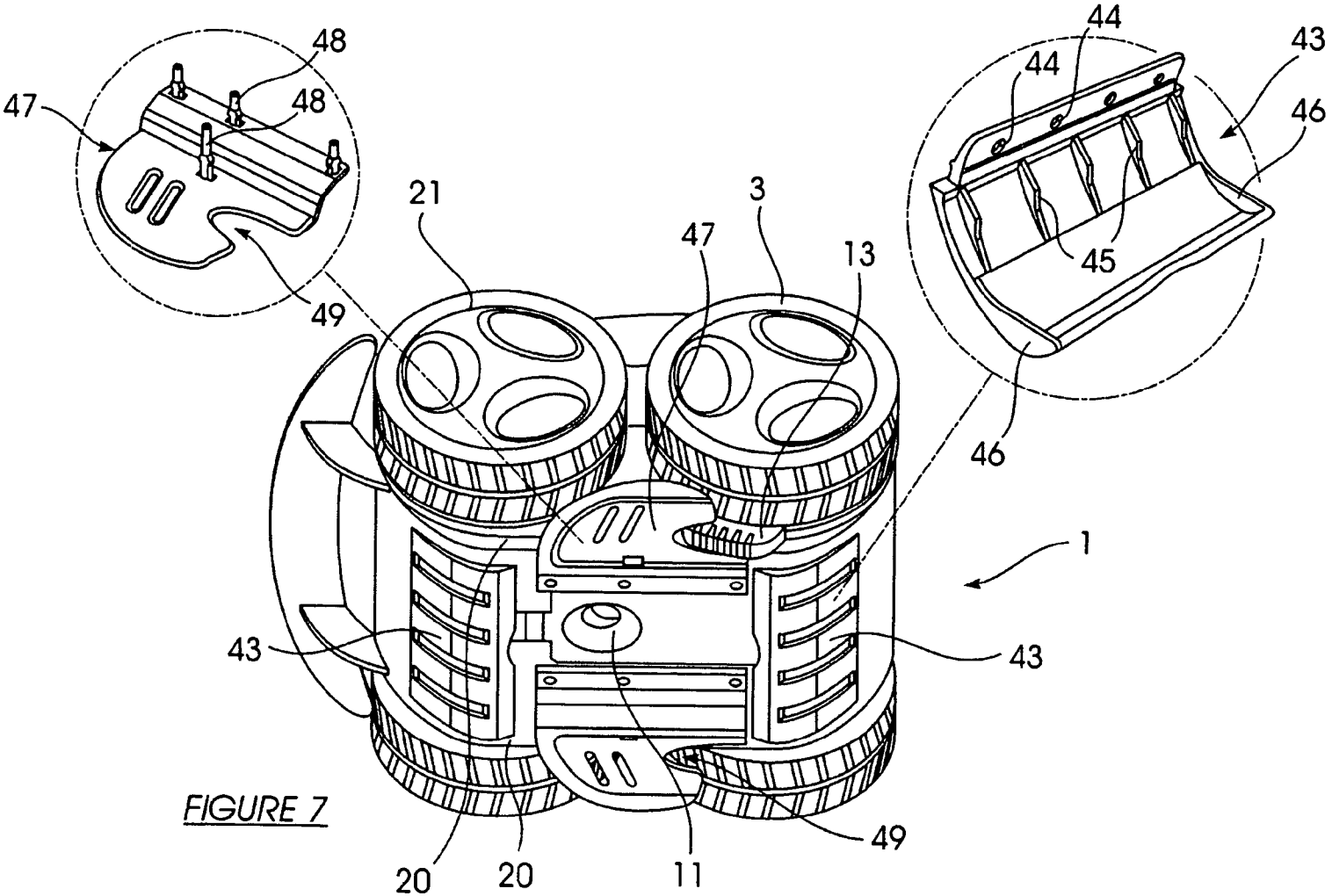
FIG. 7 shows a bottom perspective view of a cleaner with an alternative skirt arrangement.

The embodiment of the cleaner (1) shown in FIG. 7 has an alternative skirt (29) arrangement around the inlet opening (11). Front and rear flaps (43) are made from flexibly resilient elastomeric material. Each flap (43) has four holes (44) spaced apart adjacent one edge, opposite to the free edge. These holes (44) will be pressed onto co-operating enlarged formations (not shown) located on the bottom of the frame (2). The flaps (43) are movable within the sidewalls (20) of the cleaner (1), under the inherent nature of the material from which they are made. This movement is subject to the configuration of the flaps (43) with the positioning of ribs (45) and outer lips (46) to limit movement in these areas.

In addition, sidewalls (20) are recessed between the wheels (21) and (3) to receive side flaps (47). These flaps (47), which extend laterally between the wheels when in place on the cleaner (1), are made of the same flexibly resilient material as flaps (43). Four upward extensions (48) on each flap (47) provide an interference fit to corresponding holes (not shown) in the bottom of the frame (2). The side flaps (47) assist in maintaining the low pressure area below the frame (2). The flaps (47) are cured inwardly at (49) to allow passage of the formations (13) on the cams (12).

It is common to have the float of a pool cleaner spaced apart from the surface engaging portion thereof. The ballast or weight is normally located close to the surface engaging portion. The combination of a weight and a float are balanced to hold the cleaner in a required orientation when submerged during operation. This often results in a turning moment between these spaced apart components which tends to break contact between the cleaner and the surface being cleaned under certain circumstances. Wheels (3; 21) of the construction shown enable tuning with flotation material or ballast which can be used to mitigate the problem of a turning moment. It will be appreciated that depending on the nature of the body (38), either a float or a weight can be secured to the frame (2) of the cleaner (1).

The pool cleaner (1) also has a collapsible wheel assembly, which may include both flexibly resilient wheel components and a flexibly resilient wheel suspension. In the embodiment shown in the drawings, it is the wheel tread (4) that contributes to the flexibly resilient construction. The arrangement supports the underside of the cleaner (1) off a surface but gives way under any substantial load when the underside of the frame (2) provided by the lower edges of the sidewalls (20) will be pressed against the surface. This protects the components against damage. The cams (12) will, like the wheels (3), also add a degree of resilience to the suspension.

Figure 8:
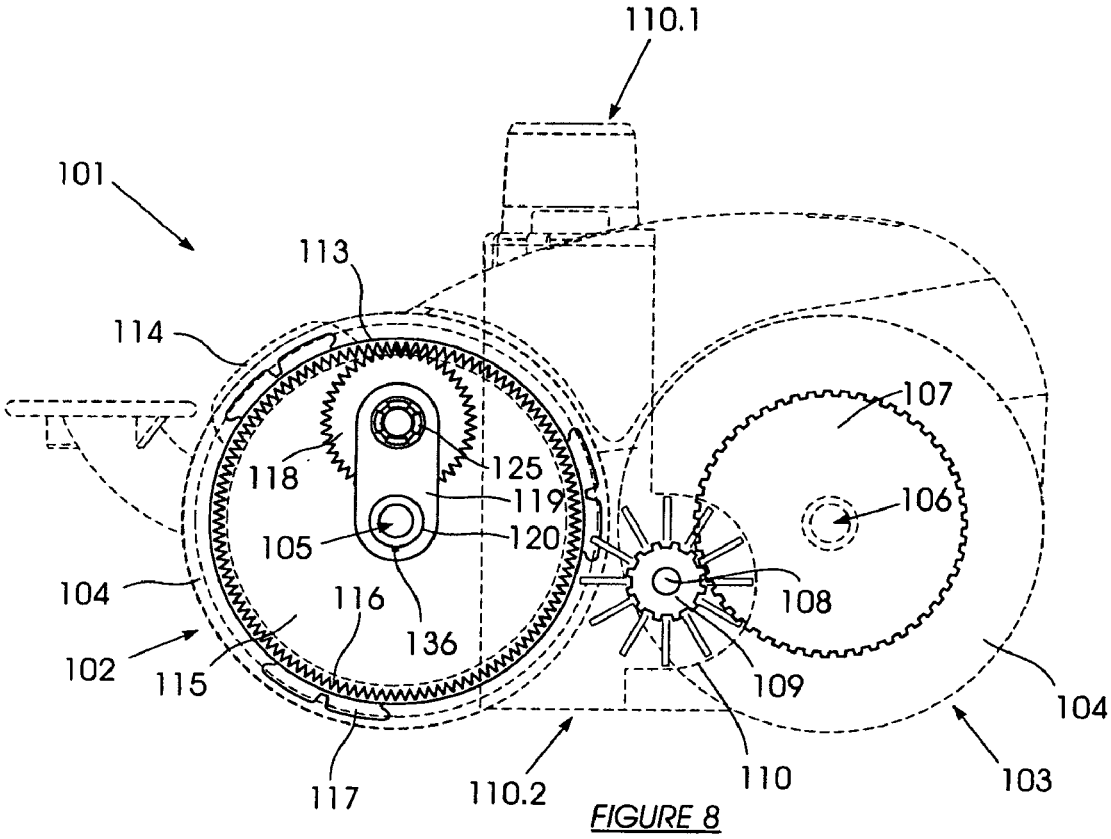
FIG. 8 shows a side view of another swimming pool cleaner.
Figure 9:
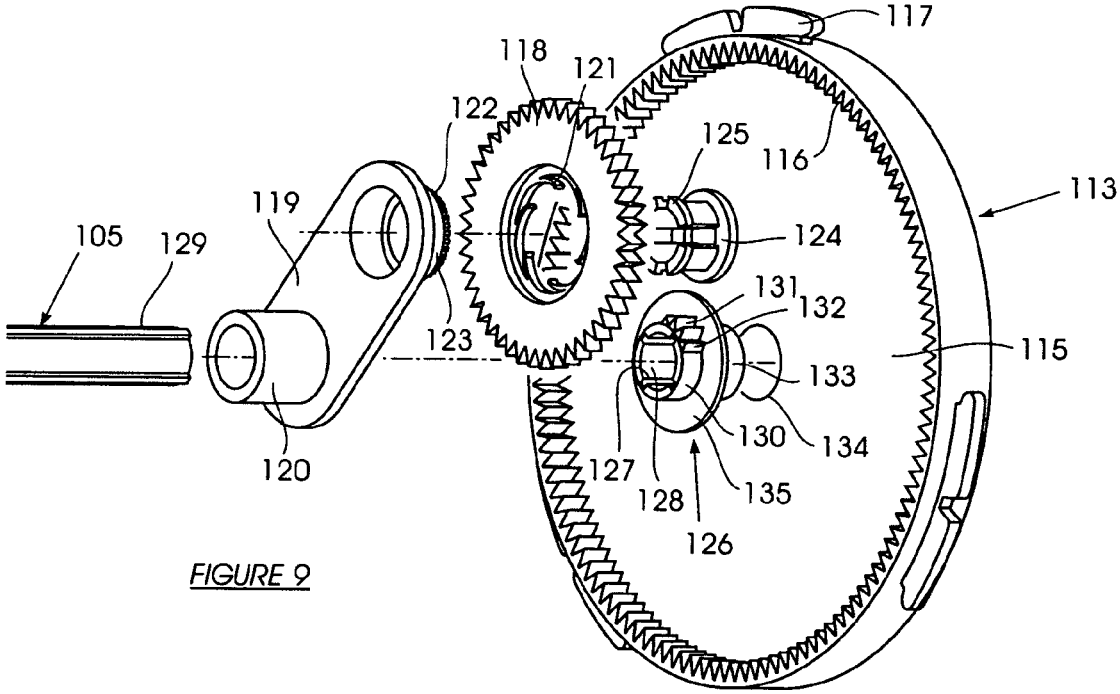
FIG. 9 shows an exploded perspective view of a turning cam and drive mechanism components for the cam.
Figure 10:
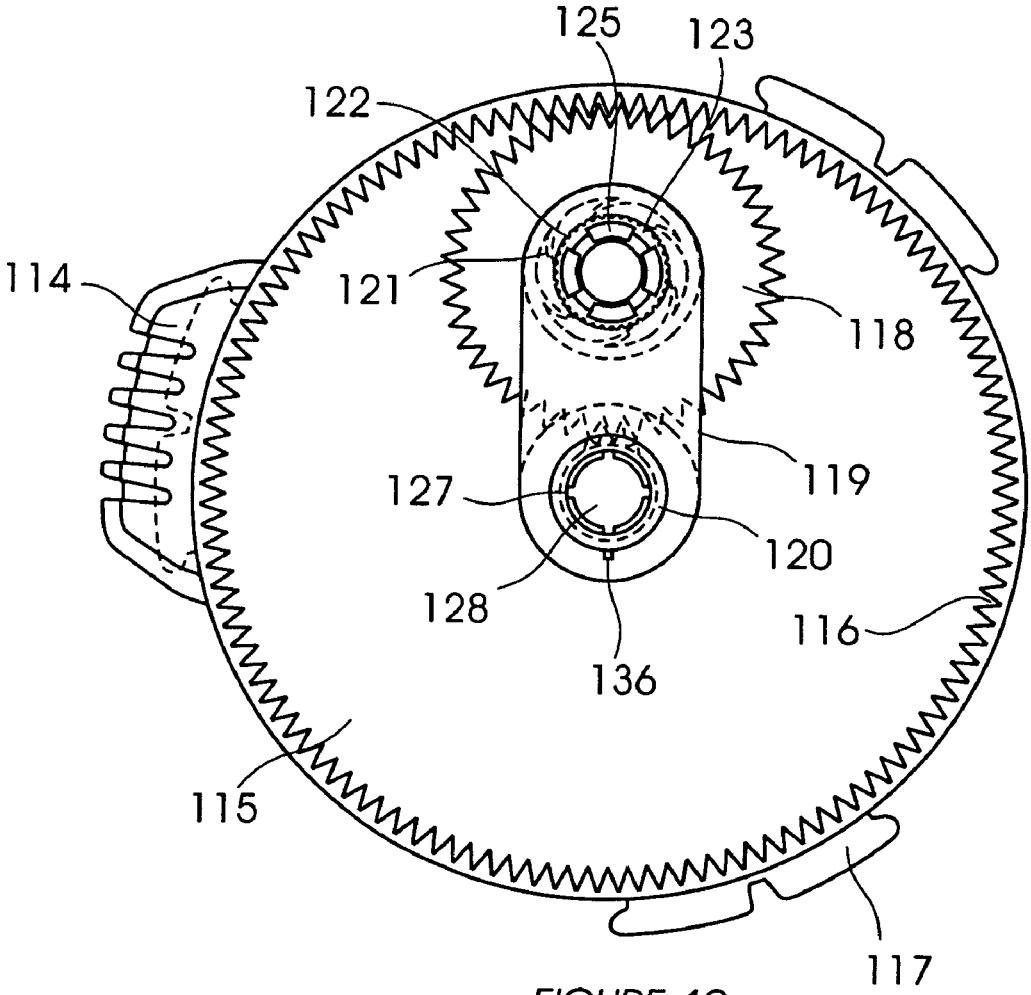
FIG. 10 shows a side view of the cam and drive mechanism components.
Figure 11:
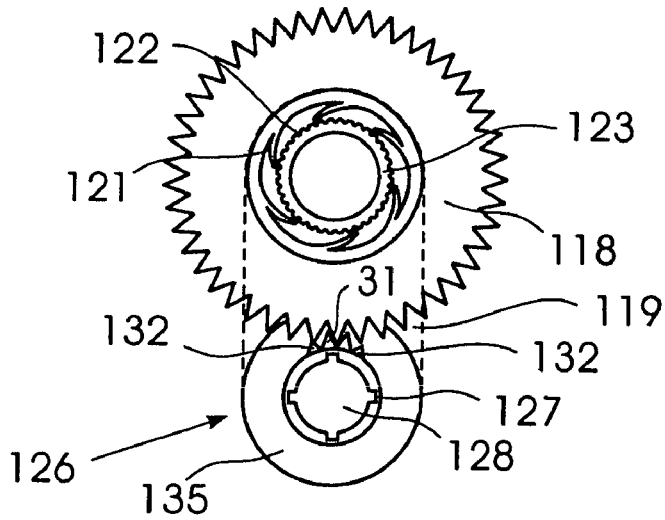
FIG. 11 shows a different side view of the components in FIG. 10.

An alternative turning mechanism is illustrated in FIGS. 8 to 11. FIG. 8 shows a pool cleaner (101) which is substantially the same as those already described and has a pair of front (102) and rear (103) wheels. The wheels (102) and (103) have tread (104) of flexibly resilient material and are mounted on a front axle (105) and a rear axle (106), respectively.

The rear axle (106) is connected through gears (107) to a drive shaft (108) extending from a turbine (109). The turbine (109) is mounted in a housing (110). A connecting shaft (not shown) extends between the rear axle (106) and front axle (105). A pair of cooperating bevel gears (not shown) respectively at the front and rear ends of the connecting shaft (not shown) transmit rotation from the rear (106) to the front (105) axle in the same manner illustrated in the pool cleaner shown in FIG. 1. This arrangement connects the wheels (102) and (103) to be driven synchronously.

Extending upwardly at the top of the housing (110) is an outlet (110.1) and an opening (110.2) in the bottom of the cleaner (101) provides an inlet to the housing (110).

Mounted rotatably about the front wheel axle (105) is a pair of annular cams (113)—these are similar to the one shown in FIG. 6. Each cam (113) sits adjacent and to the inside of the wheel (102) and includes a disc (115) integral with a ring gear (116) having lateral teeth extending inwardly. The cam (113) carries three outwardly extending, equally spaced apart, lipped projections (117). One of these is shown fitted with a gripping formation (114) in FIG. 10. The formation (114), which is made of flexibly resilient material, has a slot (not shown) which provides an interference fit onto the projection (117).

The ring gear (116) of each cam (113) engages an outer gear (118), provided as a sprocket. The sprocket (118) is carried on an arm (119) mounted by means of a boss (120) through which the axle (105) extends. The sprocket (118) includes pawls (121) which engage ratchet teeth (122) on a hollow drum (123) projecting from the arm (119). A hub (124) has resiliently flexible clips (125) which engage in the drum (123) to secure the sprocket (118) on the arm (119). This arrangement ensures unidirectional rotation of the sprocket (118).

Also carried on the axle (105) and connected to rotate with the axle (105) is an inner member (126). The member (126) has grooves (127) along a bore (128) which correspond with splines (129) on the axle (105). This member (126) forms to one side an interrupted gear (130) having a limited number of teeth (131) designed to intermittently engage the sprocket (118). Shortened lead-in and lead-out teeth (132) are provided to either side to the sprocket engaging teeth (131). This arrangement of teeth (131) and (132) serves to provide smooth engagement and disengagement with the sprocket (118) with each rotation of the axle (105).

To the other side of member (126) extends a sleeve (133). The sleeve (133) is operatively located through a central opening (134) in the cam (113) which is in turn free to rotate on this component (133). An annular flange (135) is provided between the gear (130) and sleeve (133).

The ring gear (116) is caused to rotate in an intermittent or stepwise manner in the opposite direction to that of the axle (105) and wheel (102).

The arm (119) is anchored in a preferably upright operative position to maintain the meshing components free from any collect debris. To this end, the boss (120) has a rib (136) which lies in a locating groove at the bottom of a seat (not shown) on the pool cleaner (101). A "U"-clamp (also not shown) will hold the boss (120) in the seat and fixes the arm (119) in the desired position.

Operation of the turning cams (113) is substantially the same as that described with reference to the pool cleaner shown in FIG. 1—the main difference being that it is the front wheels (2) that are lifted when the cams (113) engage the submerged surface. The gearing of the drive mechanisms for the cams (113) is again selected so that their cycle of rotation is slower than that of the wheels (102) and (103). Having the cams (113) at the front wheels (2) may assist where a cleaner (101) becomes lodged with the edge of a step between the front and rear wheels, for example.

Moving the cams (114) to rear wheels (103) can be done with little difficulty as the wheel drive train components remain unchanged. The longer axle with the cams (114) and cam drive mechanisms is simply switched to the rear wheels (103).

It will be appreciated by suitably skilled persons that a number of variations may be made to the features of the described embodiments without departing from the scope of the invention.

The cams need not be annular and could be arcuate or spoked formations, for example. A number of different gear and transmission arrangements for the wheels and cams may also be used. As a further example, in a variation of the cam operation, a foot can be driven to extend an inwardly biased engaging formation to engage the operating surface. The formation can extend forwardly from the frame at a suitably inclination to lift an adjacent wheel and to impart the required rearward movement to the frame as it extends. Such an engaging formation could be mounted on an elongate arm which may be curved. As a further alternative, the gripping formation may be provided on an arm having the teeth of a rack along it. The cam will be provided as a co-operating pinion with corresponding teeth on only part of its circumference. The cam will engage the rack only intermittently to extend the engaging formation against an inward bias.

The cleaner may alternatively be of the pressure operated kind, wherein dirt is entrained and carried into a collection net in known manner.

The invention claimed is:

1. A swimming pool cleaner having wheels driven by a turbine to move the cleaner in a direction of travel along a submerged surface with a cam adjacent and on the axis of at least one of the wheels adjacent that wheel and to rotate in an opposite direction thereto to intermittently extend a gripping formation beyond the operatively supporting surface of the at least one wheel so that the gripping formation imparts movement to the cleaner opposite to the direction of travel.

2. A pool cleaner as claimed in claim 1 in which the cam is circular with at least one radial gripping formation on its outer surface.

3. A pool cleaner as claimed in claim 2 in which the gripping formations are removably securable to the cam.

4. A pool cleaner as claimed in claim 1 in which the cam is driven in a cycle retarded relative to that of the wheels.

5. A pool cleaner as claimed in claim 1 in which a turbine drive shaft is connected through gearing to the axle for the at least one wheel, which axle is connected through gearing to a ring gear on the cam.

6. A pool cleaner as claimed in claim 1 in which the turbine is in a housing with an inlet at the underside of the pool cleaner and having a skirt arranged around the inlet, extending downwardly from the underside of the pool cleaner with at least part of the skirt movably suspended with a free edge of the skirt movable inwardly against a resilient bias.

7. A pool cleaner as claimed in claim 1 in which the wheels are adapted to receive a flotation or ballast body.

8. A pool cleaner as claimed in claim 7 in which the wheels have tread that securably engages over hub-caps.

9. A swimming pool cleaner having turbine driven wheels with an annular cam adjacent at least one of the wheels mounted for rotation on a driven axle for the at least one wheel, the cam having an internal ring gear and at least one gripping formation that protrudes past the wheel periphery, an inner gear mounted on the axle for rotation with the at least one wheel and an outer gear supported between the inner gear and ring gear to rotate the cam in a direction opposite to the rotation of the wheel.

10. A pool cleaner as claimed in claim 9 in which the inner gear is an interrupted gear member to cause intermittent stepwise rotation of the ring gear.

11. A pool cleaner as claimed in claim 9 in which the outer gear is a sprocket supported for unidirectional rotation on an arm.

12. A pool cleaner as claimed in claim 10 in which the gear member includes shortened lead-in and lead-out gear teeth.

13. A pool cleaner as claimed in claim 10 in which the outer gear is a sprocket supported for unidirectional rotation on an arm.

* * * * *